US008381894B2

(12) United States Patent
Nurnberg et al.

(10) Patent No.: US 8,381,894 B2
(45) Date of Patent: Feb. 26, 2013

(54) POWER TRANSMISSION SYSTEM FOR PEOPLE MOVER

(75) Inventors: Thomas Nurnberg, Port Byron, IL (US); Glen Collison, Rock Island, IL (US)

(73) Assignee: Kone Corporation, Helsinki (FI)

( * ) Notice: Subject to any disclaimer, the term of this patent is extended or adjusted under 35 U.S.C. 154(b) by 259 days.

(21) Appl. No.: 12/836,768

(22) Filed: Jul. 15, 2010

(65) Prior Publication Data

US 2011/0024262 A1 Feb. 3, 2011

Related U.S. Application Data

(60) Provisional application No. 61/228,201, filed on Jul. 24, 2009.

(51) Int. Cl.
*B66B 23/02* (2006.01)

(52) U.S. Cl. ..... 198/330

(58) Field of Classification Search ..... 198/330
See application file for complete search history.

(56) References Cited

U.S. PATENT DOCUMENTS

| | | | | |
|---|---|---|---|---|
| 1,468,134 | A * | 9/1923 | Brunner et al. | 384/459 |
| 1,759,943 | A * | 5/1930 | Herrmann | 184/11.1 |
| 4,775,044 | A * | 10/1988 | Hofling | 198/330 |
| 5,224,580 | A * | 7/1993 | Nurnberg et al. | 198/330 |
| 5,348,131 | A | 9/1994 | Yamaguchi et al. | |
| 5,379,877 | A | 1/1995 | Hoefling | |
| 5,950,797 | A | 9/1999 | Aulanko et al. | |
| 6,119,845 | A | 9/2000 | Song | |
| 6,155,401 | A | 12/2000 | Lunardi et al. | |
| 6,161,674 | A | 12/2000 | Aulanko et al. | |
| 7,069,802 | B2 | 7/2006 | Mikhail et al. | |
| 7,159,705 | B2 | 1/2007 | Ogimura et al. | |
| 7,677,041 | B2 * | 3/2010 | Woollenweber | 60/608 |
| 2004/0206603 | A1 * | 10/2004 | Lunardi | 198/335 |
| 2008/0053788 | A1 * | 3/2008 | Ishikawa et al. | 198/330 |
| 2009/0173596 | A1 * | 7/2009 | Fang et al. | 198/330 |

FOREIGN PATENT DOCUMENTS

| | | |
|---|---|---|
| AT | 340822 | 4/1975 |
| DE | 585818 | 11/1934 |
| DE | 874206 | 4/1953 |
| DE | 35 26 905 A1 | 7/1985 |
| GB | 1 445 555 A | 8/1976 |
| JP | 05-097368 A | 4/1993 |
| WO | WO-93/15015 | 8/1993 |
| WO | WO-97/31854 | 9/1997 |

OTHER PUBLICATIONS

International Search Report Issued Sep. 7, 2010 in International Patent Application No. PCT/US2010/042153.
Written Opinion issued Sep. 7, 2010 in International Patent Application No. PCT/US2010/042153.

* cited by examiner

*Primary Examiner* — Gene Crawford
*Assistant Examiner* — Keith R Campbell
(74) *Attorney, Agent, or Firm* — Venable LLP; Steven J. Schwarz; Robert Kinberg

(57) ABSTRACT

A power transmission system for a people mover includes a transmission housing, a first motor having a motor shaft, an output gear located inside the transmission housing, and a plurality of gears located inside the transmission housing. The plurality of gears includes an output gear located inside the transmission housing, and first and second reduction gears cooperating to drive the output gear. At least one of the first and second reduction gears has an input/output shaft extending outside the transmission housing. The system also includes an external reduction stage located outside the transmission housing and driven by the first motor shaft to rotate the input/output shaft.

17 Claims, 12 Drawing Sheets

POWER TRANSMISSION SYSTEM FOR PEOPLE MOVER

CROSS-REFERENCE TO RELATED APPLICATIONS

This patent application claims priority under 35 U.S.C. §119 to U.S. Provisional Application No. 61/228,201, filed Jul. 24, 2009, the entire content of which is incorporated herein by reference.

TECHNICAL FIELD

This patent application relates generally to people movers, such as escalators and moving walkways.

More specifically, this patent application relates to a power transmission system for people movers.

BACKGROUND

Drives for people movers, such as escalators and moving walkways, typically fall into three main categories: inside the stepband direct drives; outside the stepband direct drives; and outside the stepband chain drives. Drives located inside the stepband typically have the advantage of keeping the pit area free for escalator maintenance. However, the drives located in the stepband can be difficult to service, and/or can be limiting in package space due to their location within the stepband.

Of the drives located outside the stepband, the chain drive is the most common. This type of drive often has the advantage of keeping all the serviceable items in the escalator pit. However, it can also have the disadvantages of being relatively less efficient, using up a relatively large amount of pit room, and/or being environmentally unfriendly due to having oil on the exposed main drive chain. Other systems with the drive located outside the step have failed to locate the serviceable side of the drive in the pit.

SUMMARY

Embodiments of the present invention can provide a power transmission system that is significantly narrower than prior art systems. For example, by using ball bearings, deep groove ball bearings, cylindrical roller bearings, and/or spherical roller bearings to support the gears of the power transmission system, the width of the housing can be minimized in comparison with known configurations using other types of bearings, such as taper roller bearings. In addition, the power transmission system according to the present invention can provide flexibility in installation and configuration due to having various configurations at the input, the output, the type and configuration of gears inside the housing, and/or the configuration of the housing itself.

According to an illustrative embodiment, the present invention relates to a power transmission system for a people mover, comprising a transmission housing; a first motor having a motor shaft; a plurality of gears located inside the transmission housing, comprising an output gear located inside the transmission housing, and first and second reduction gears cooperating to drive the output gear, at least one of the first and second reduction gears having an input/output shaft extending outside the transmission housing; and an external reduction stage located outside the transmission housing and driven by the first motor shaft to rotate the input/output shaft.

According to an illustrative embodiment, the external reduction stage comprises a belt or chain extending between the motor shaft and the input/output shaft. The external reduction stage can further comprise a first pulley coupled to the motor shaft; and a second pulley coupled to the input/output shaft; wherein the belt or chain extends around the first pulley and the second pulley. According to another illustrative embodiment, the external reduction stage comprises a gear reduction unit interconnecting the motor shaft and the input/output shaft.

According to an illustrative embodiment, the external reduction stage can be removable from the motor shaft and the input/output shaft, and the system can further comprise an internal reduction stage connecting the motor shaft to the first reduction gear. The input/output shaft can provide a power take off when the external reduction stage is removed from the input/output shaft. The internal reduction stage can comprise an input gear located on the motor shaft and in engagement with the first reduction gear. Alternatively, the internal reduction stage can comprise a first pulley located on the motor shaft, and a belt or chain extending around the first pulley and a portion of the first reduction gear.

According to an illustrative embodiment, the transmission housing can include first and second opposed sidewalls, and the system can further comprise a first bearing coupled to the first sidewall to support one of the plurality of gears for rotation about an axis; and a second bearing coupled to the second sidewall to support the one of the plurality of gears for rotation about the axis; wherein the first bearing transmits axial loads from the one of the plurality of gears to the first sidewall along the axis, and the second bearing does not transmit axial loads from the one of the plurality of gears to the second sidewall along the axis. The power transmission system can further comprise a first removable cap covering an aperture in the first sidewall, wherein the first bearing is immovable with respect to the first removable cap in the axial direction, and the first bearing is immovable with respect to the one of the plurality of gears in the axial direction. The power transmission system can further comprise a second removable cap covering an aperture in the second sidewall, wherein the second bearing is slidably mounted to the second removable cap, or the second bearing is slidably mounted to the one of the plurality of gears. According to an illustrative embodiment, the transmission housing includes first and second opposed sidewalls and an end wall extending between the first and second sidewalls, and the system further comprises an auxiliary power take off removably mounted to the end wall over an aperture, the auxiliary power take off including a take-off gear driven by the output gear through the aperture, and a take-off shaft driven by the take-off gear. A removable end plate can cover the aperture when the auxiliary power take off is removed from the end wall. At least one of the first bearing and the second bearing can comprise a ball bearing, a deep groove ball bearing, a cylindrical roller bearing, or a spherical roller bearing.

According to an illustrative embodiment, the power transmission system can further comprise a second motor having a second motor shaft that drives the first reduction gear. According to another illustrative embodiment, the power transmission system can further comprise a second motor having a second motor shaft, and a second plurality of gears driven by the second motor shaft to drive the output gear.

According to an illustrative embodiment, a people mover can include the power transmission system. The people mover can include a main drive shaft coupled to a drive wheel to circulate a plurality of interconnected passenger platforms. The output gear of the power transmission system can include a central aperture that slides onto the main drive shaft and transfers rotational movement to the main drive shaft.

According to an illustrative embodiment, a second power transmission system having a second output gear can be provided, wherein the second output gear includes a second central aperture that slides onto the main drive shaft and transfers rotational movement to the main drive shaft.

Further aspects, objectives, and advantages, as well as the structure and function of exemplary embodiments, will become apparent from a consideration of the description, drawings, and examples.

BRIEF DESCRIPTION OF THE DRAWINGS

The foregoing aspects and other features and advantages of the invention will be apparent from the following drawings, wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention. All references cited herein are incorporated by reference as if each had been individually incorporated.

Figure 1:
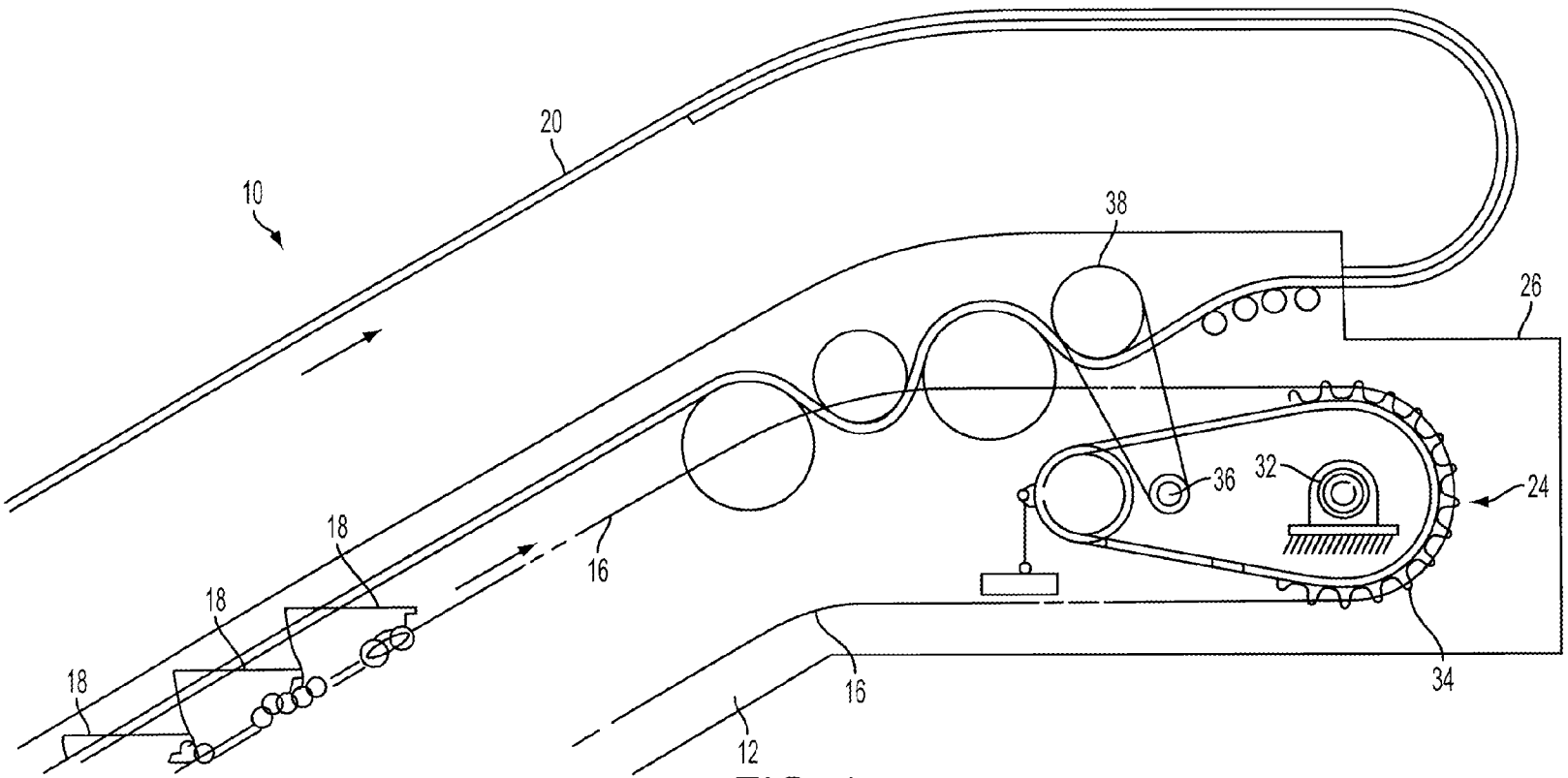
FIG. 1 PRIOR ART
FIG. 1 is a side, schematic view of a portion of a people mover, particularly an escalator, according to the prior art.

FIG. 1 is a side, schematic view of a portion of a people mover 10, particularly an escalator, according to the prior art. As is generally known, such a people mover 10 can include a stationary main frame, generally designated 12, which can support a conveyor assembly having a pair of horizontally spaced drive chains 16, a plurality of passenger platforms or steps 18 drivingly engaged with the chains 16, and a pair of horizontally spaced circuitous handrails 20. As is known, each platform 18 may be fixed to drive chains 16 and have rollers 22, which run in a rail or track (not shown) mounted on main frame 12. Chains 16 and handrails 20 can be driven in synchronism by a power transmission system, generally designated 24, to continuously move passenger platforms 18 in an endless path between a lower landing (not shown) and an upper landing 26.

The power transmission system 24 can include an electric motor (not shown in FIG. 1) that drives a main drive shaft 32 of the people mover 10 to turn a sprocket 34 that engages one of the drive chains 16 for circulating the passenger platforms 18. The power transmission system 24 can also include a power take off shaft 36 that drives a belt and pulley system 38 to drive one of the handrails 20. A power transmission system 24 may be located on each side of the people mover 10 to move the respective drive chains 16 and hand rails 20. The power transmission system 24 can also be used in conjunction with a horizontal people mover, such as a moving sidewalk. For further details regarding the people mover of FIG. 1, see U.S. Pat. No. 5,224,580 to Nurnberg et al., the entire content of which is expressly incorporated herein by reference.

Figure 2:
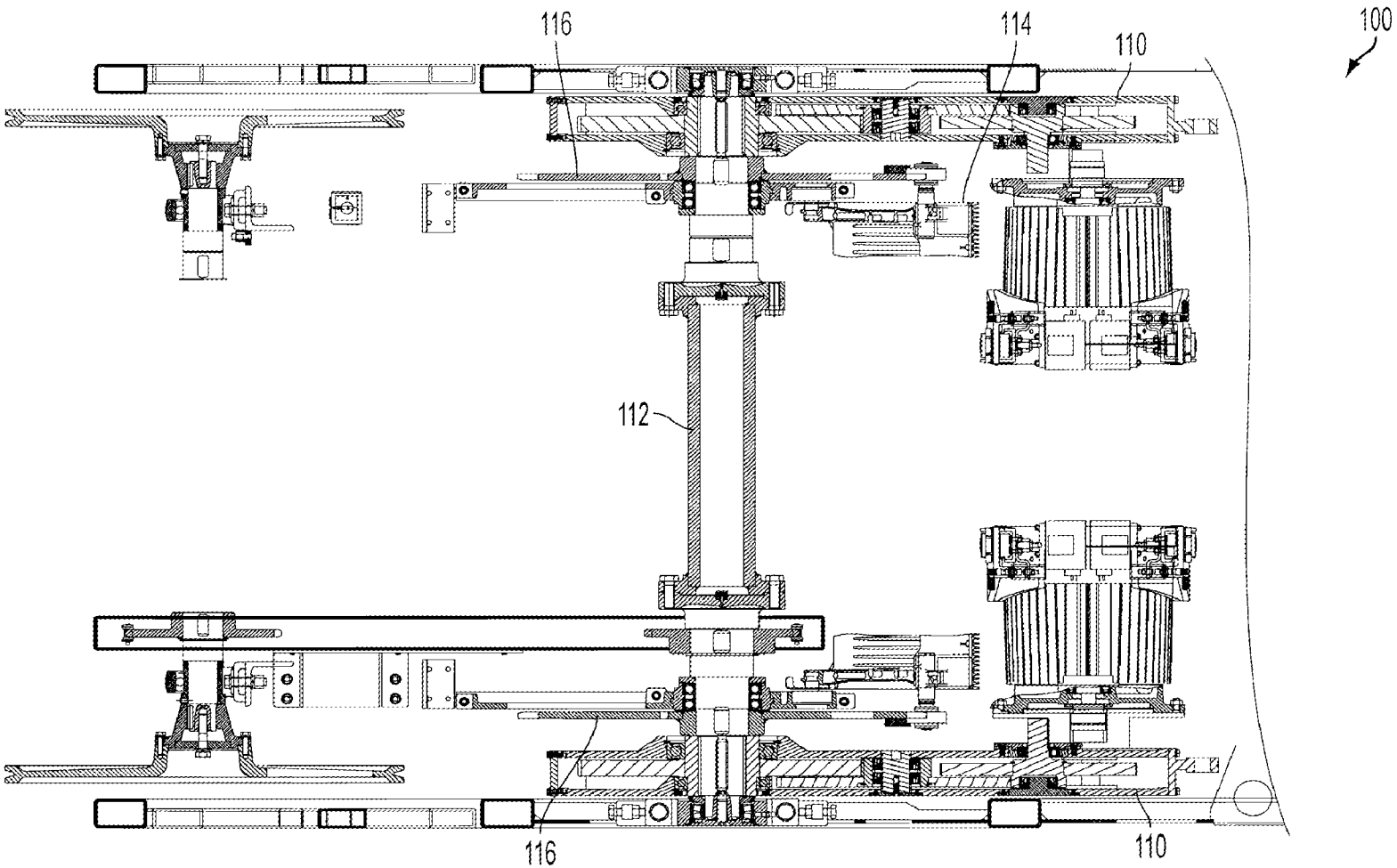
FIG. 2 is a top, schematic view of a portion of a people mover according to an illustrative embodiment of the present invention, with portions shown in cross-section.

FIG. 2 is a top, schematic view of a portion of a people mover 100 according to an illustrative embodiment of the present invention, with portions shown in cross-section. For sake of convenience, and without limitation, only the components of the people mover 100 necessary for description of the present invention will be described in detail. The people mover 100 can include a power transmission system 110 located on one or both of its lateral sides. The power transmission system 110 will be described in more detail below. The power transmission system 110, or pair of power transmission systems 110 (if provided) can drive the main drive shaft 112, which in turn, can circulate a plurality of passenger platforms 114 (only one shown), for example, through one or more sprockets 116. Since the power transmission system 110 is flat and thin, it can be mounted outside the sprocket 116 with the output of the power transmission system 110 coupled to the main drive shaft 112 from the outermost side of the people mover 100, however, other configurations are possible. One of ordinary skill in the art will appreciate that other configurations besides sprockets 116 can be used to transfer movement from the main drive shaft 112 to the platforms 114.

Figure 3:
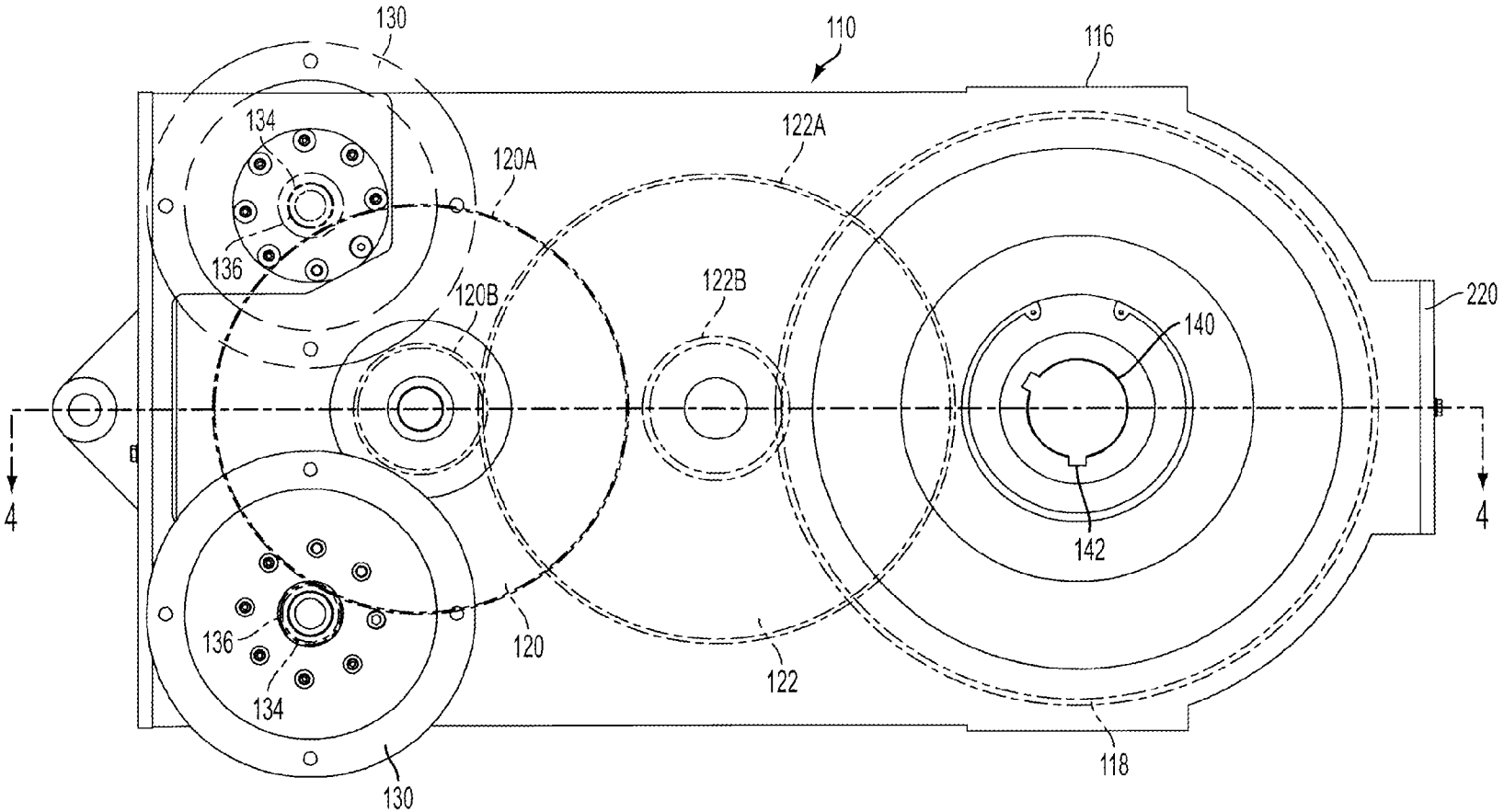
FIG. 3 is a side view of an illustrative transmission system of the people mover of FIG. 2, shown having two motors, wherein internal components are illustrated in dashed-lines.

FIG. 3 is a side view of an illustrative embodiment of the power transmission system 110, wherein internal components are illustrated in dashed-lines. The power transmission system 110 generally includes a transmission housing 116, such as a gear box, that houses and supports a plurality of gears. For example, the plurality of gears can include an output gear 118 that mounts, for example, on the main drive shaft 112 (FIG. 2) of a people mover. The plurality of gears can also include a first reduction gear 120 and a second reduction gear 122 that cooperate to drive the output gear 118. One of ordinary skill in the art will appreciate that the power transmission system 110 can have more or less than the first and second reduction gears 120 and 122 driving the output gear 118. For example, an alternative embodiment may have four or five reduction gears driving the output gear 118.

Still referring to FIG. 3, the first reduction gear 120 can include a first gear portion 120A and a second gear portion 120B fixed together for co-rotation. The first gear portion 120A and second gear portion 120B can have different pitch circles in order to provide a gear reduction. The second reduction gear 122 can similarly have a first gear portion 122A and a second gear portion 122B fixed together for co-rotation. According to an illustrative embodiment, the second gear portion 120B of the first reduction gear 120 can engage and drive the first gear portion 122A of the second reduction gear 122. Further, the second gear portion 122B of the second reduction gear 122 can engage and drive the output gear 118. The output gear 118 and first and second reduction gears 120, 122 can be mounted to the housing 116, for example, using shafts, bearings, and other configurations, further details of which will be provided below.

As discussed throughout this application, the power transmission system 110 according to the present invention can provide flexibility in installation and configuration due to having various configurations for the input, the output, the gears inside the housing 116, and the configuration of the housing 116 itself. For example, the power transmission system can have various options for the first stage gear reduction (i.e., between the motor and the plurality of gears inside the housing 116). The power transmission system 110 can have both internal (e.g., inside housing 116) and external (e.g., outside housing 116) options for a first stage gear reduction, as will be described in more detail below.

Figure 4:
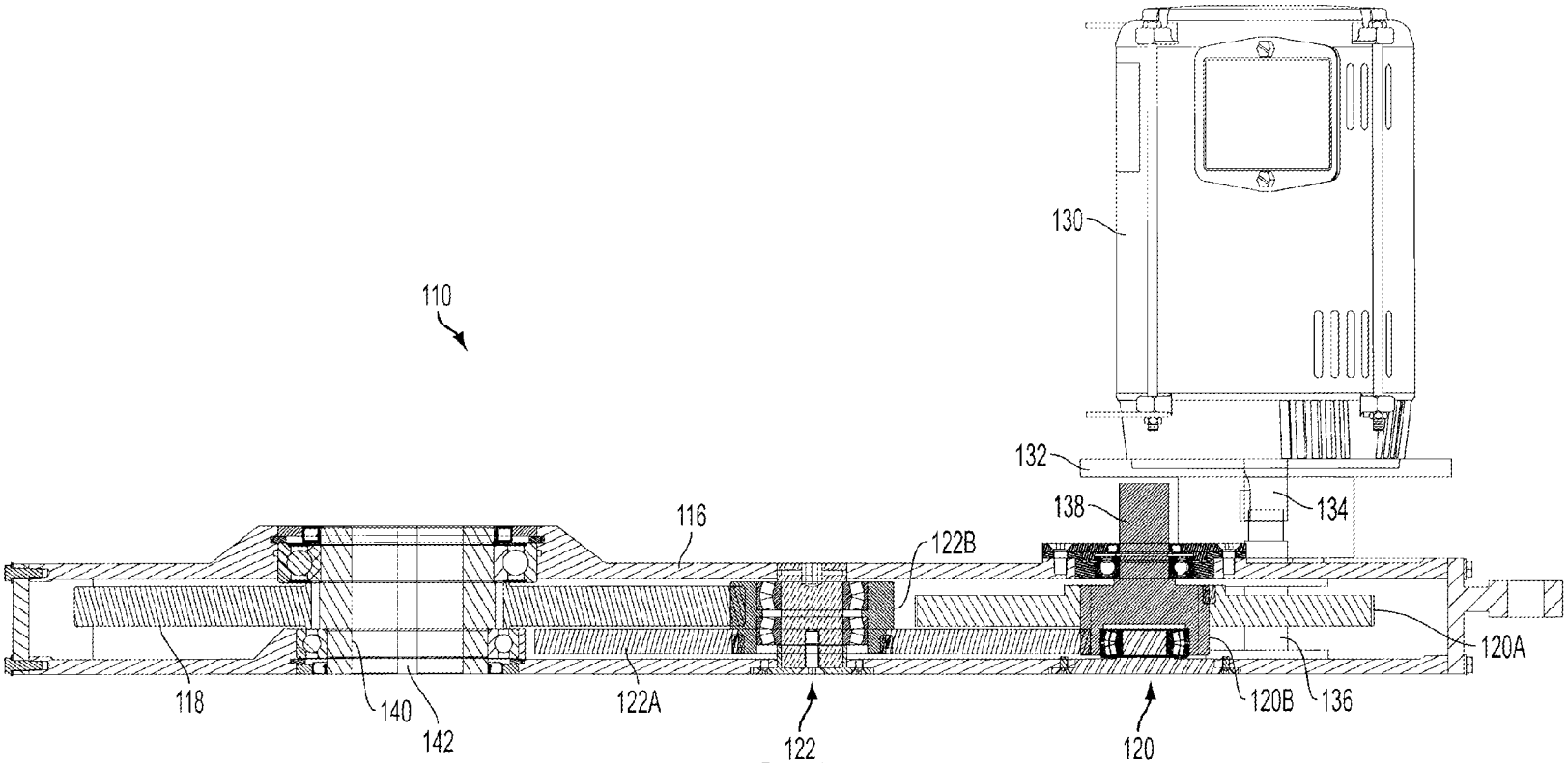
FIG. 4 is a cross-sectional view of the transmission system and one of the motors of FIG. 3, taken along line IV-IV of FIG. 3.
Figure 5:
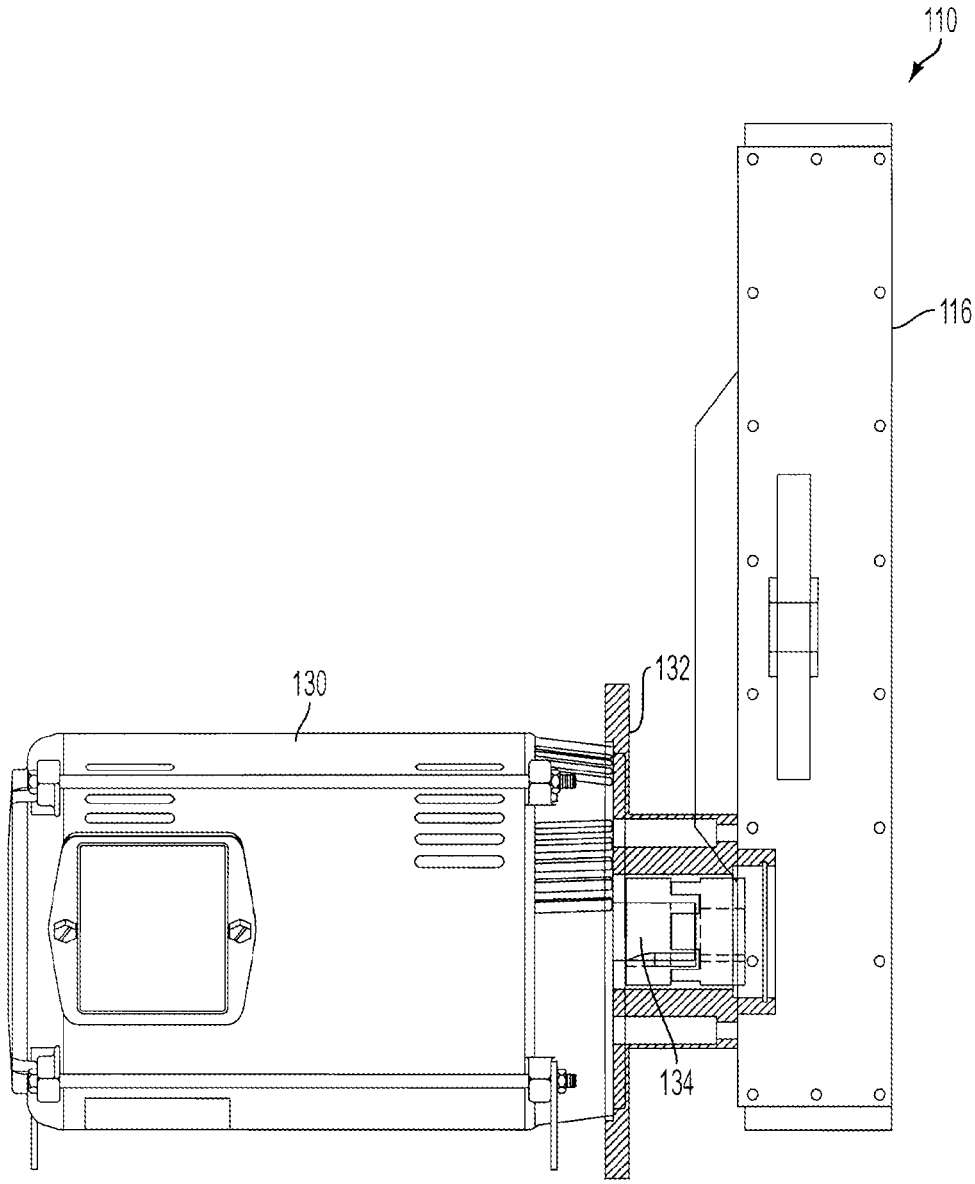
FIG. 5 is an end view of the transmission system of FIG. 3, shown having one motor, wherein a portion of the motor mount is shown in cross-section.

FIGS. 3-5 depict an illustrative configuration where the motor 130 is removably mounted to the housing 116, for example, using a motor mount 132 (see FIGS. 4 and 5). The motor 130 has a motor output shaft 134. The first stage reduction can comprise an input gear 136 (see FIG. 4) coupled to the motor output shaft 134 and in engagement with the first gear portion 120A of the first reduction gear 120.

Although two motors 130 and two input gears 136 are shown driving the first reduction gear 120 in FIGS. 3-5, the power transmission system 110 can alternatively have a single motor 130 and a single input gear 136 driving the first reduction gear 120. Although not shown, each of the gears 120, 122, 136 have teeth, such as, for example, helical teeth or spur teeth.

Referring to FIG. 4, when the power transmission system 110 is configured with the internal first reduction stage of FIGS. 3-5, the first reduction gear 120 can provide a power take off. For example, as shown in FIG. 4, the first reduction gear 120 can include an input/output shaft 138 that extends outside the housing 116 and is driven by rotation of the first reduction gear 120. The input/output shaft 138 can be used, for example, to drive a handrail 20 or other components of a people mover. Alternatively, the input/output shaft 138 can support a brake (e.g., a band brake or a disk brake).

Referring to FIGS. 3 and 5, the output gear 118 can include a central aperture 140 that can be dimensioned to slide onto the main drive shaft 112 of a people mover. The output gear 118 can be coupled to the main drive shaft 112 in order to drive it, for example, using a shaft/key structure 142, or other type of structure known in the art.

Figure 6:
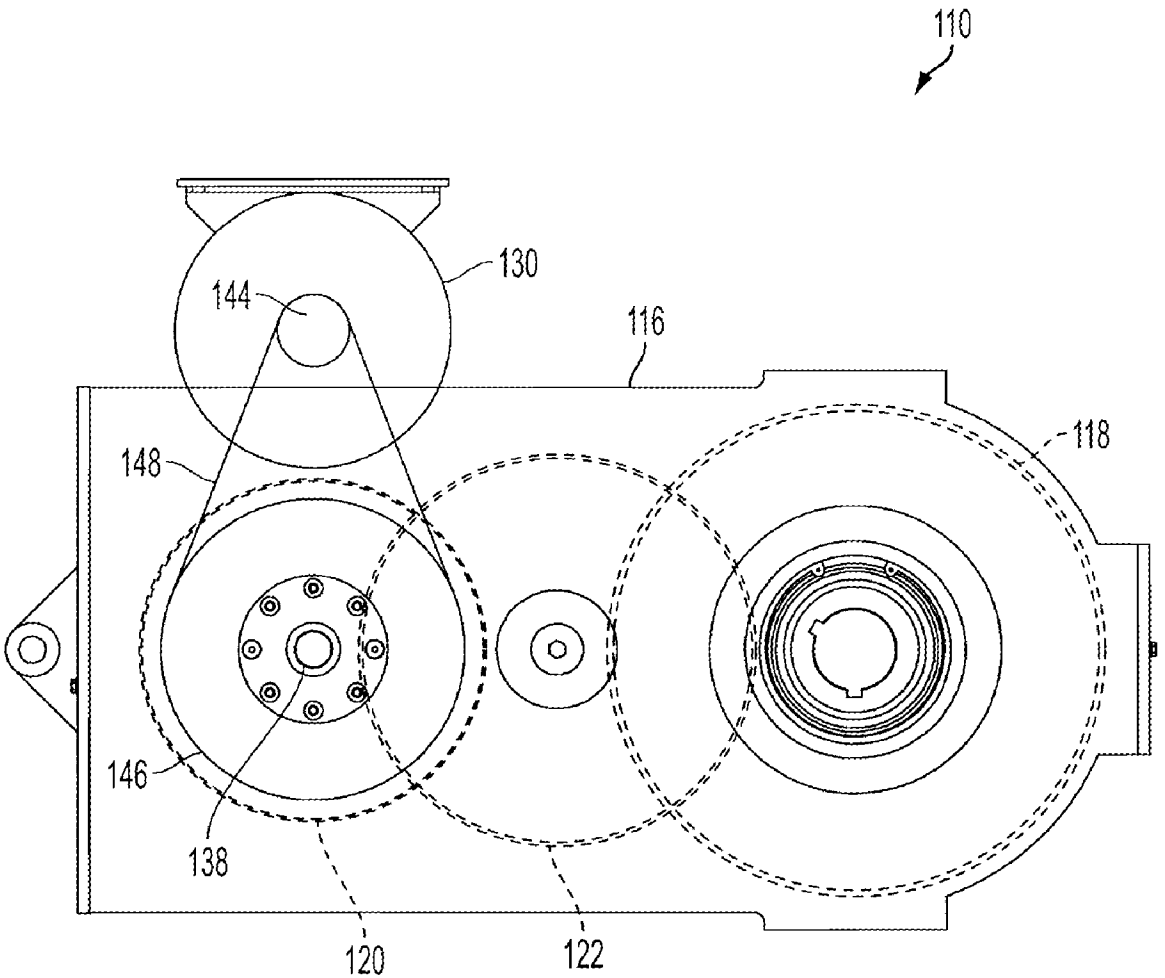
FIG. 6 is a side view of the transmission system of FIG. 3, shown in an illustrative configuration where the first reduction stage is located outside the transmission housing.

FIG. 6 is a side view of the power transmission system 110 reconfigured to use a first reduction stage located outside the transmission housing 116. Except as described below, the power transmission system 110 is substantially the same as described above in connection with FIGS. 3-5. In the illustrative configuration of FIG. 6, the motor 130 can drive the first reduction gear 120 through the input/output shaft 138. For example, a first gear or pulley 144 can be coupled to the motor output shaft (hidden in FIG. 6), and a second gear or pulley 146 can be removably mounted on the input/output shaft 138, outside the housing 116. A chain, such as a gear chain, or belt 148 can extend around the first pulley 144 and second pulley 146 to facilitate the motor 130 driving the first reduction gear 120. The first pulley 144 and second pulley 146 can have different pitch diameters, in order to provide the desired change in gear ratio. Gear chains may have the advantage of smoother and/or quieter power transmission than gears.

In the illustrative configuration of FIG. 6, the motor 130 is not mounted to the housing 116 by the motor mount 132, but rather, is mounted to some other part of the people mover, or its surrounding area. However, the configuration of FIG. 6 can also be implemented with the motor 130 mounted on the housing 116, for example, with the motor mount 132.

Figure 7A:
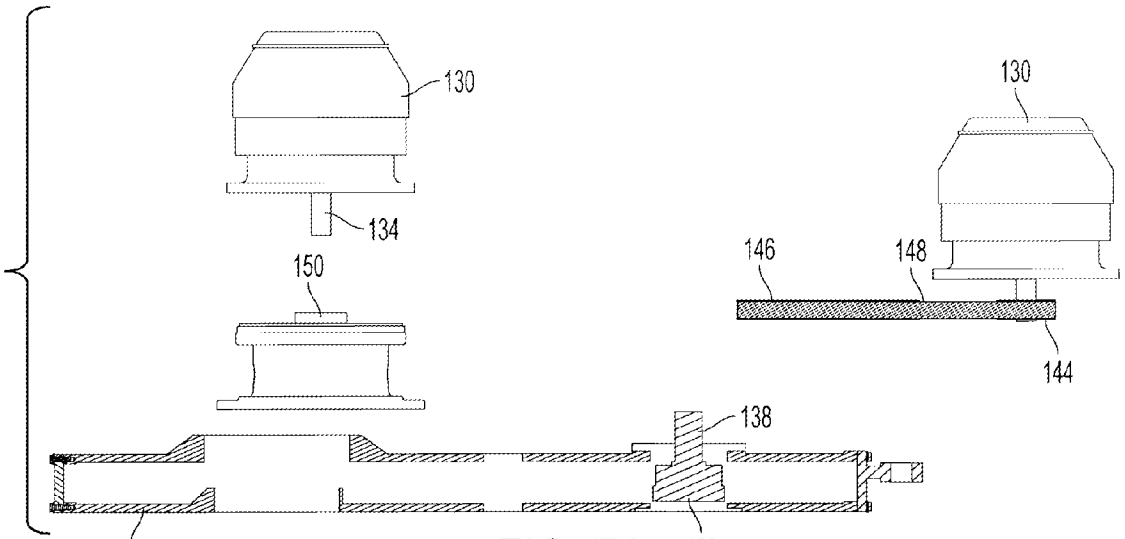
FIGS. 7A and 7B are top, partial cross-sectional views depicting a variety of illustrative configurations for the first reduction stage of the transmission system of FIG. 3.
Figure 7B:
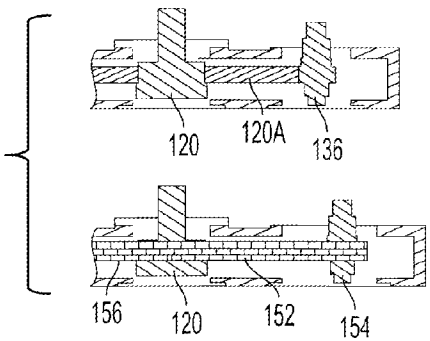

FIGS. 7A and 7B are top, partial cross-sectional views depicting a variety of illustrative configurations for the first reduction stage of the transmission system of FIG. 3. FIG. 7A depicts illustrative external configurations of the first reduction stage, while FIG. 7B depicts illustrative internal configurations of the first reduction stage.

Referring to FIG. 7A, the motor 130 can drive the first reduction gear 120 (only partially shown) through input/output shaft 138 using first and second gears or pulleys 144, 146, respectively, and a chain (such as a gear chain) or belt 148. Further details regarding this illustrative configuration are provided above in connection with FIG. 6. According to another illustrative embodiment shown in FIG. 6, the external first stage reduction can comprise a gear reduction unit 150 coupled to the motor output shaft 134 and the input/output shaft 138. According to an illustrative embodiment, the gear reduction unit 150 can comprise, for example, a planetary gear reduction, a worm gear reduction, or a bevel gear reduction.

Still referring to FIG. 7A, the belt or chain configuration of the first reduction stage (right side of FIG. 7A) and the gear reduction unit 150 configuration (left side of FIG. 7A) can be readily interchanged with one another, for example, by removing the gear reduction unit 150 from the input/output shaft 138 and replacing it with the second gear or pulley 146, or vice versa. In addition, both configurations of the external first reduction stage can be removed completely, for example, when an internal first reduction stage is being used. In this case, the input/output shaft 138 may be used as a power take off, as described previously.

FIG. 7B depicts illustrative configurations of an internal first reduction stage, which can be used interchangeably with the external first reduction stages of FIG. 7A. The top of FIG. 7B depicts the illustrative embodiment of FIGS. 3-5, where the internal first reduction stage comprises an input gear 136 driven by the motor 130 to drive the first gear portion 120A of the first reduction gear 120. The bottom of FIG. 7B depicts another illustrative configuration where the internal first reduction stage comprises a belt or chain 152 (such as a gear chain) interconnecting the motor output shaft 134 and the first reduction gear 120. For example, a first gear or pulley 154 can be mounted on the motor output shaft 134, and the first reduction gear 120 can include a second gear or pulley 156 coupled thereto, with the belt or chain 152 encircling the first gear or pulley 154 and the second gear or pulley 156.

Still referring to FIG. 7B, the geared configuration of the first reduction stage (top of FIG. 7B) and the belt/chain configuration of the first reduction stage (bottom of FIG. 7B) can be readily interchanged with one another, for example, by replacing the input gear 136 and first gear portion 120A with the first gear or pulley 154 and second gear or pulley 156, respectively, or vice versa. In addition, both configurations of the first reduction stage shown in FIG. 7B can be readily removed, for example, in the case where the external first reduction stage is used.

Figure 8:
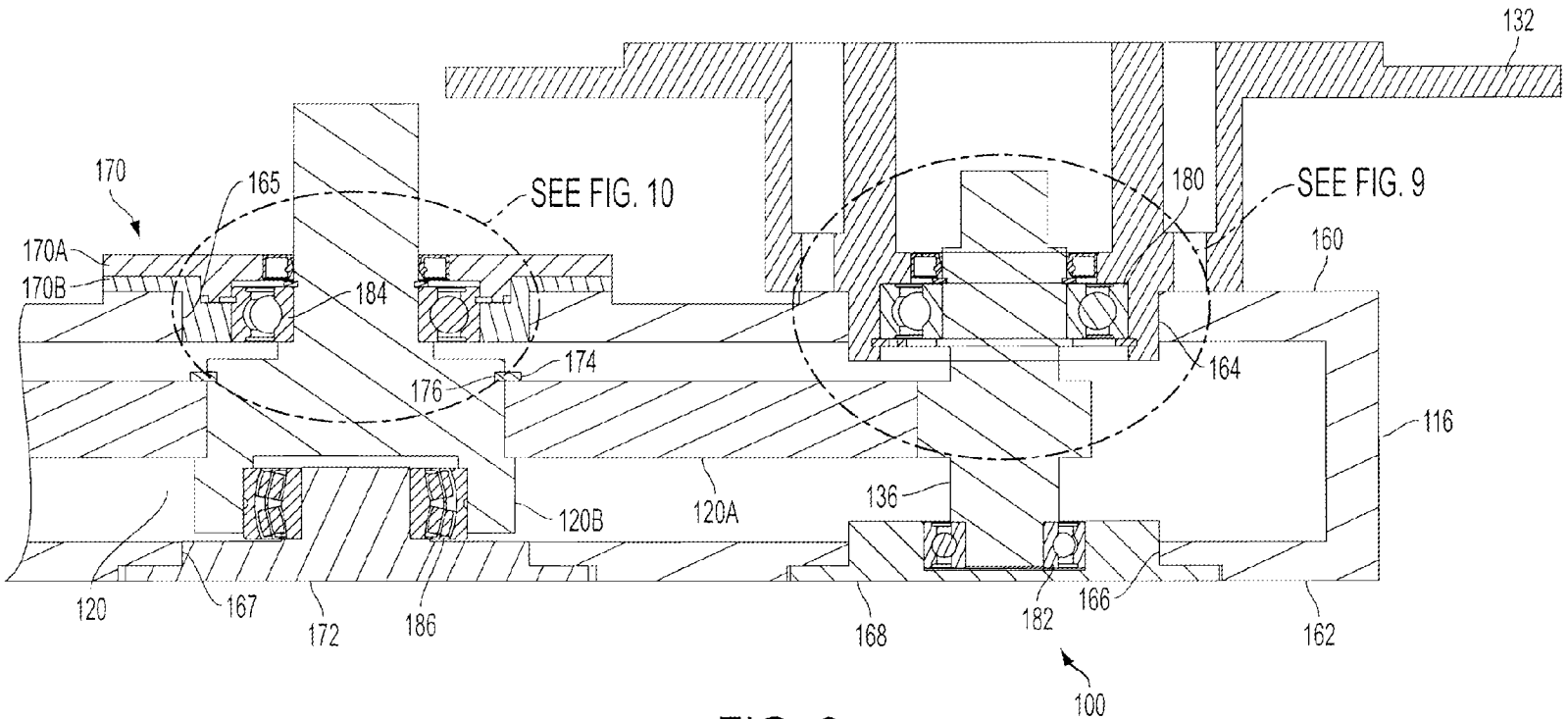
FIG. 8 is a top, cross-sectional view of a portion of the transmission system of FIG. 3, showing an illustrative bearing configuration for supporting an input gear and an illustrative bearing configuration for supporting the first reduction gear.

FIG. 8 is a top, cross-sectional view of a portion of the power transmission system 110, showing illustrative bearing configurations for supporting the input gear 136 and the first reduction gear 120. The housing 116 can have first and second opposed sidewalls 160, 162 between which the input gear 136 and first reduction gear 120 are mounted.

The first sidewall 160 and second sidewall 162 can define respective apertures 164, 166 in the area of the input gear 136. Similarly, the first sidewall 160 and second sidewall 162 can define respective apertures 165, 167 in the area of the first reduction gear 120.

The aperture 164 in the first sidewall 160 can be covered by the motor mount 132 or other cap like structure to retain the input gear 136 in the housing 116. Similarly, the aperture 166 in the second sidewall 162 can be covered by a cap 168 or other similar structure to retain the input gear 136 in the housing 116. The aperture 165 in the first sidewall 160 and the aperture 167 in the second sidewall 162 can be covered by caps 170, 172, respectively, which retain the first reduction gear 120 in the housing 116.

Figure 10:
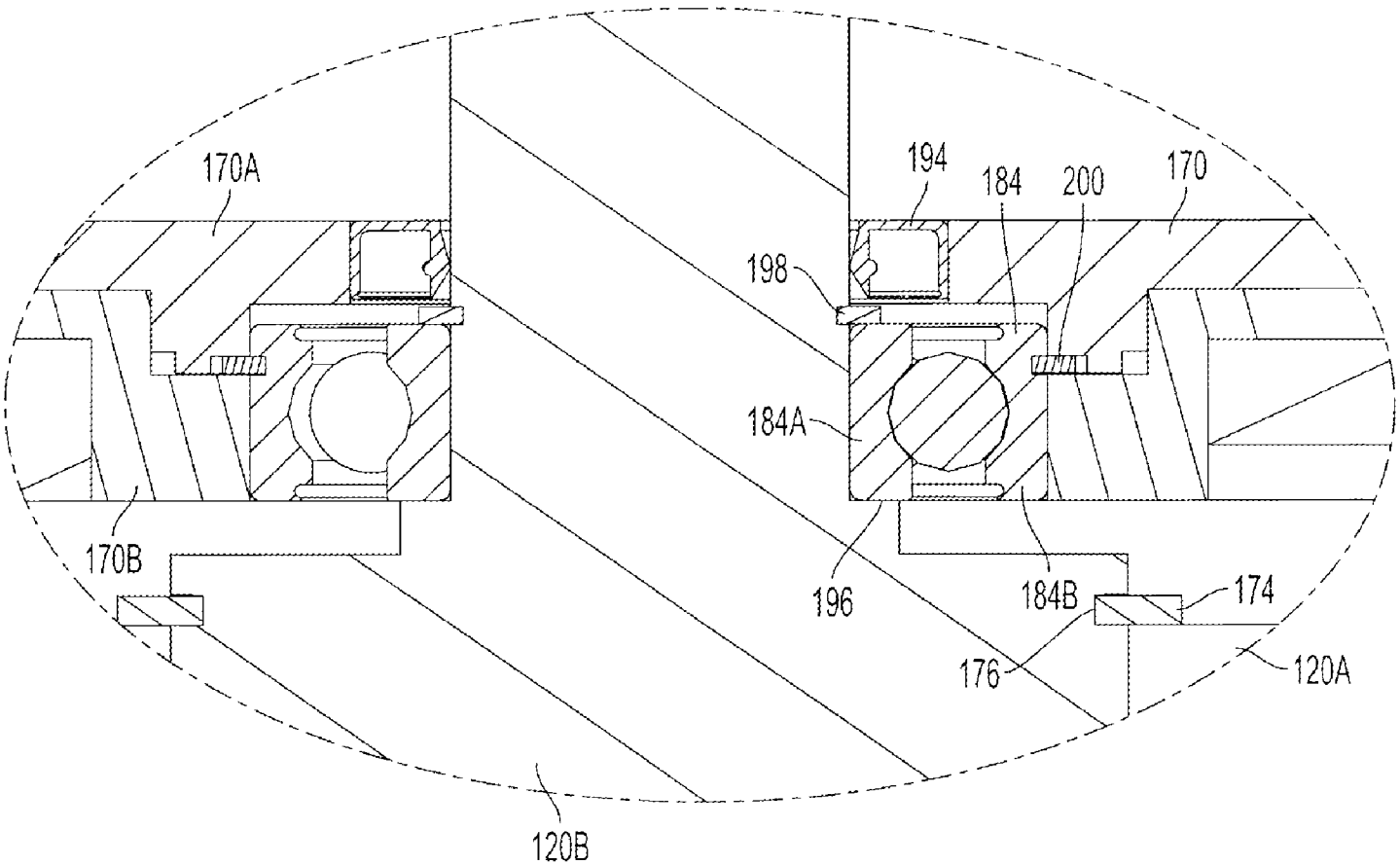
FIG. 10 is an enlarged portion of FIG. 8, showing the illustrative bearing configuration for supporting the first reduction gear.

The motor mount 132, cap 168, 170, and/or cap 172 can be removed from the housing 116, for example, using fasteners (not shown), to provide easy access to the input gear 136 or the first reduction gear 120. Alternatively, the motor mount 132, cap 168, 170, and/or cap 172 can be removed from the housing 116 to facilitate removal of the input gear 136 or first reduction gear 120 from the housing 116. As shown in FIGS. 8 and 10, the first gear portion 120A of the first reduction gear 120 can be removably mounted on the second gear portion 120B using, for example, using a snap ring 174 seated in a groove 176. This configuration can facilitate separation of the first gear portion 120A and second gear portion 120B, for example, from within the housing 116, for example, when an external first reduction stage is being used.

Still referring to FIG. 8, the input gear 136 can be mounted to the housing 116 by a first bearing 180 supported by the first sidewall 160 (e.g., seated in motor mount 132) and a second bearing 182 supported by the second sidewall 162 (e.g., seated in cap 168). Similarly, the first reduction gear 120 can be mounted to the housing 116 by a first bearing 184 supported by the first sidewall 160 (e.g., seated in cap 170) and a second bearing 186 supported by the second sidewall 162 (e.g., seated in cap 172). The bearings 180, 182, 184, and 186 can comprise ball bearings or other types of contact bearings known in the art.

The bearings 180, 182 and 184, 186 can be configured such that only the bearings on one side of input gear 136 and/or first reduction gear 120, respectively, bear any axial load, thereby reducing or eliminating the need for conical thrust bearings and/or shimming. For example, as described in more detail with respect to FIG. 9, the first bearing 180 can be fixed to the motor mount 132 and input gear 132 in such a manner that the first bearing 180 bears the axial loads between the input gear 132 and the first sidewall 160. The same can apply for first bearing 184, as described in more detail with respect to FIG. 10. However, the second bearing 182 and second bearing 186 can be configured so as not to transmit axial loads between the input gear 136 and/or first reduction gear 120 and the second sidewall 162, respectively. For example, the second bearing 182 can slide in the axial direction with respect to the input gear 136 and/or the second sidewall 162 (e.g., via cap 168). Similarly, the second bearing 186 can slide in the axial direction with respect to the first reduction gear 120 and/or the second sidewall 162 (e.g., via cap 172). The same principles can apply to the second reduction gear 122 and output gear 118, shown, for example, in FIG. 3.

Figure 9:
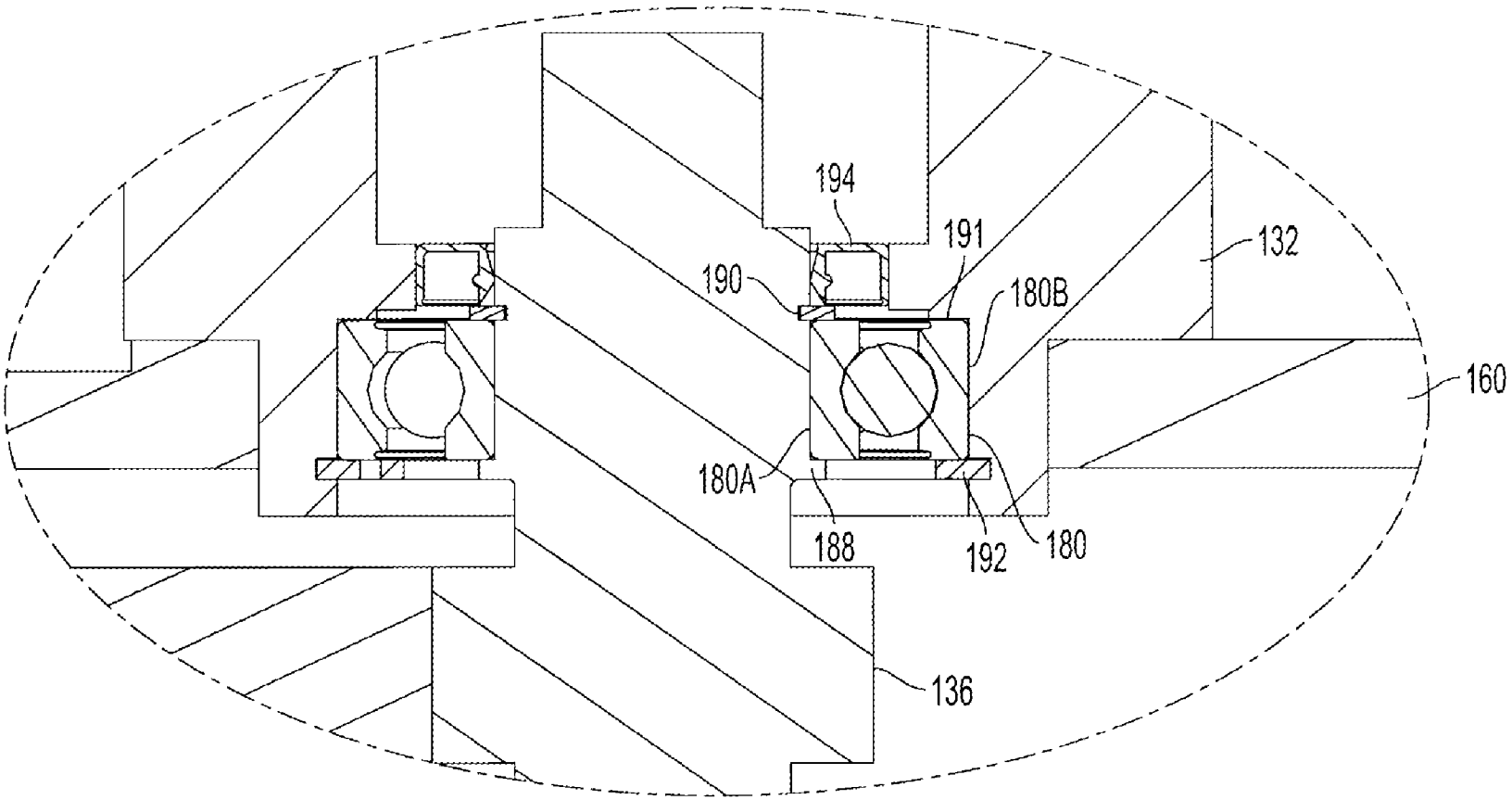
FIG. 9 is a enlarged portion of FIG. 8, showing the illustrative bearing configuration for supporting the input gear.

Referring to FIG. 9, the arrangement of first bearing 180 is shown in more detail. The first bearing 180 can be retained on the input gear 136 such that substantially no axial movement is possible between the two parts. For example, the inner race 180A of the first bearing can be retained on the input gear 136 between a shoulder 188 on the input gear 136 and a removable snap ring 190 on the input gear.

The first bearing 180 can also be retained on the first sidewall 160 such that substantially no axial movement is possible between the two parts. For example, the outer race 180B of the first bearing 180 can be retained on the motor mount 132 between a shoulder 191 on the motor mount 132 and a removable snap ring 192 on the motor mount 132. The removable snap rings 190, 192 can permit the bearing 180 to be removed and replaced without substantial disassembly of the power transmission system 110. As shown in FIG. 9, a removable dust shield 194 can prevent dust, dirt, or other contaminants from entering the first bearing 180.

Referring to FIG. 10, the arrangement of first bearing 184 is shown in more detail. The first bearing 184 can be retained on the second gear portion 120B of the second reduction gear 120 such that substantially no axial movement is possible between the two parts. For example, the inner race 184A can be retained between a shoulder 196 on the second gear portion 120B and a removable snap ring 198 on the second gear portion 120B.

The first bearing 184 can also be retained on the first sidewall 160 such that substantially no axial movement is possible between the two parts. For example, the outer race 184B can be retained on the cap 170 by a removable snap ring 200 engaging both the second race 184B and the cap 170. In the illustrative embodiment shown, the cap 170 comprises an outer portion 170A and an inner portion 170B that mate with one another, and the removable snap ring 200 can be sandwiched between the outer portion 170A and inner portion 170B. Thus, removal of the bearing 184 can be accomplished by removing the outer portion 170A to free the snap ring 200, in addition to removing the snap ring 198 from the second gear portion 120B, however, other configurations are possible.

The design of the power transmission system 110 shown in FIGS. 8-10, and discussed above, can create the needed space to fit outside the stepband of the people mover, inside the truss, while keeping the power transmission system 110 easy to service. For example, most of the serviceable parts can be located in the accessible area of the pit. For example, the motor 130 and the majority of the bearings 180, 182, 184, 186 may all be accessed without having to remove passenger platforms.

The bearings 180, 182, 184, and 186 can comprise ball bearings, deep groove ball bearings, cylindrical roller bearings, or spherical roller bearings, which do not require shimming during assembly or during replacement. This is because, as discussed above, axial loads can be contained with cooperating shoulders and snap rings on the gears and caps. This design can make the power transmission system 80% or more serviceable from the pit. Service possible from the pit can include that of the bearings, gears, caps, and axles.

In addition, the exclusive use of ball bearings, deep groove ball bearings, cylindrical roller bearings, and/or spherical roller bearings can allow the power transmission system 110, and particularly the housing 116, to be as narrow as possible, because these types of bearings are typically thinner than the bearings used in conventional power transmission systems, such as taper roller bearings. Also, the ball bearings, deep groove ball bearings, cylindrical roller bearings, and/or spherical roller bearings may be low internal-clearance bearings, which are of a higher grade than would be found on conventional power transmission systems.

Figure 11:
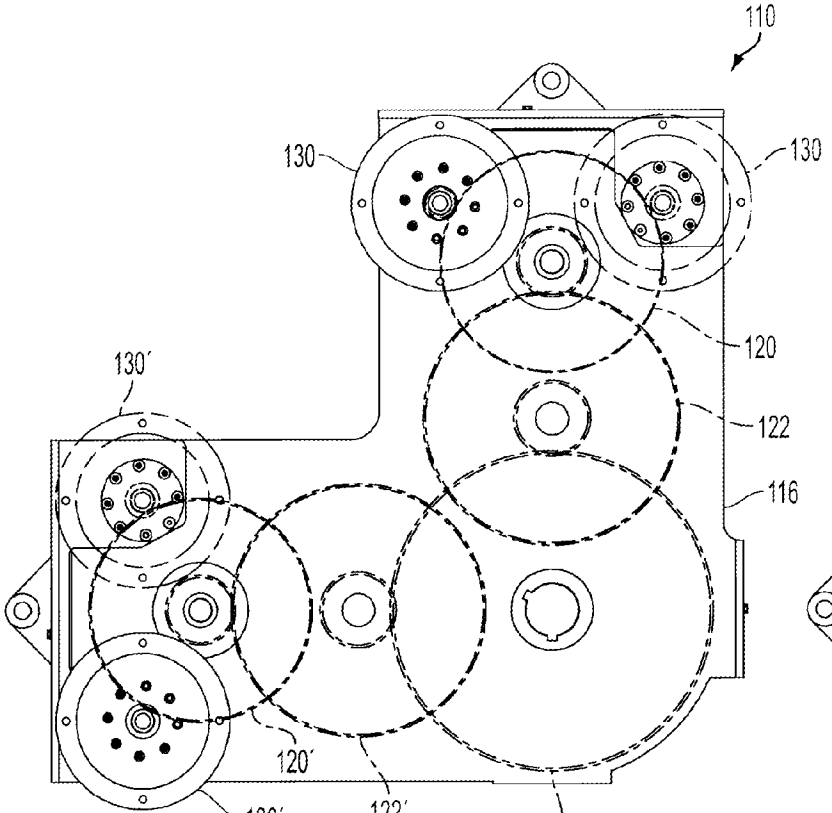
FIG. 11 is a side view of another illustrative embodiment of the gear box of FIG. 3, shown having first and second sets of motors and gears driving the output gear.

FIG. 11 is a side view of another illustrative embodiment of the power transmission system 110, having first and second sets of motors and gears driving the output gear. For example, in addition to motors 130 driving first reduction gear 120 and second reduction gear 122 to drive output gear 118, the power transmission system 110 can have a second set of motors and gears driving the output gear 118. For example, as shown, housing 116 can contain a second plurality of gears including first reduction gear 120' driving second reduction gear 122', which in turn drives the output gear 118. One or more motors 130' can drive the first reduction gear 120', as shown. In the illustrative embodiment shown, the first set of motors and gears is offset with respect to the second set of motors and gears by an angle of approximately 90 degrees (with respect to the output gear 118), however other configurations are possible, such as an 180 degree offset, or both an 180 degree offset for one set of gears, and a 90 degree offset for another set of gears. The illustrative embodiment of FIG. 11 can provide a total of four motors 130, 130' driving one output gear 118. Using this same system on both of the opposite sides of a people mover (e.g., a "dual drive") can yield eight input motors for such a people mover. Therefore, the total power input may range from approximately 3 kW to more than 60 kW, depending on speed, width, AC frequency, and other necessary and known parameters.

Figure 12:
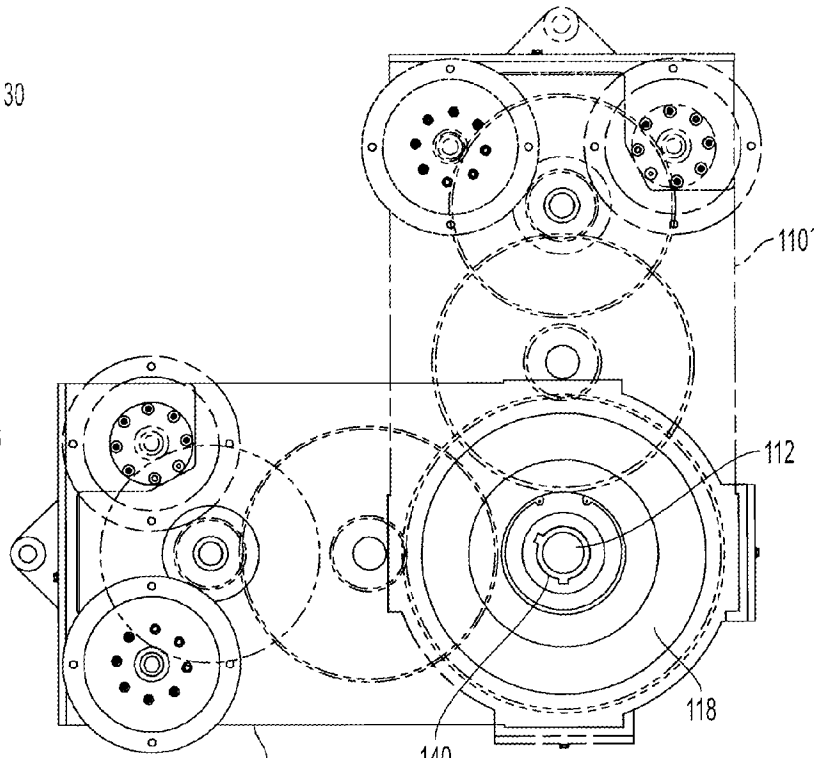
FIG. 12 is a side view of an illustrative configuration of two of the transmissions of FIG. 3 stacked on the main drive shaft of a people mover.

FIG. 12 is a side view of an illustrative configuration of two power transmission systems 110, 110' stacked on the main drive shaft 112 of a people mover. For example, power transmission system 110 can have an output gear 118 with a central aperture 140 that slides onto and drives the main drive shaft 112, as discussed above. Similarly, a second power transmission system 110' can have an output gear (hidden from view) with a central aperture (hidden from view) that slides onto and drives the main drive shaft 112. Any number of power transmission systems may be mounted to the main drive shaft 112 to power the people mover. The power transmission systems 110, 110' are not required to be at 90 degree angles to one another, as shown. Rather, other angles are possible.

Figure 13:
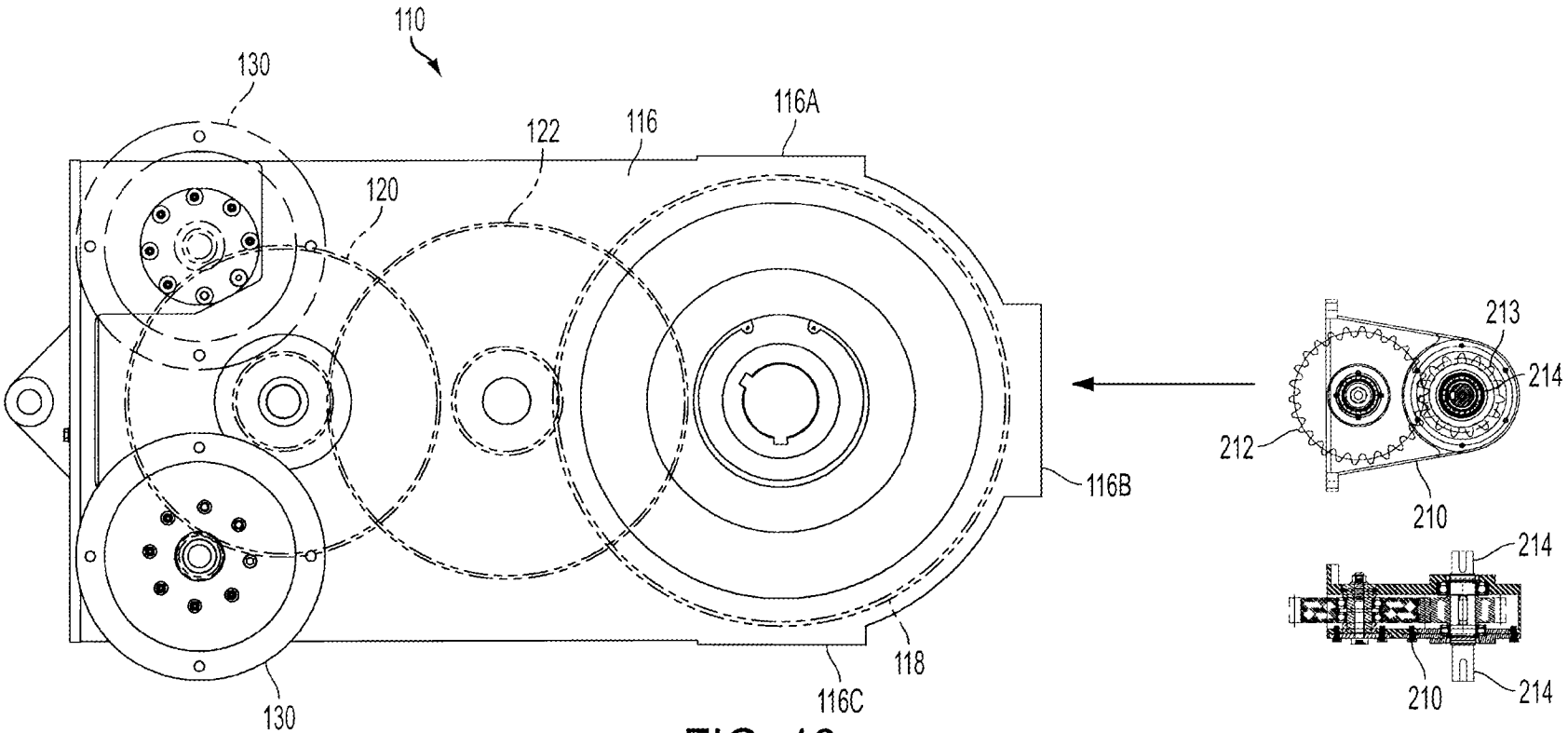
FIG. 13 is a side view of the transmission system of FIG. 3, shown with an illustrative embodiment of a removable auxiliary power take off.

FIG. 13 is a side view of the transmission system of FIG. 3, shown with an illustrative embodiment of a removable auxiliary power take off 210. The power take off 210 comprises a modular "plug and play" unit that can be removably and replaceably mounted on the housing 16, for example, over an aperture at one of the end walls 116A, 116B, or 116C, for example, using fasteners (not shown). The power take off 210 can include at least one take off gear 212 that engages the output gear 118, or other gear in housing 116, to transfer power to a take off shaft 214. For example, the take off gear 212 can engage gear teeth 213 formed on the take off shaft 214, or otherwise coupled thereto. The take off shaft can be used to power other people mover components, such as a handrail. When the power take off 210 is not being used, an end plate 220 (see FIG. 3) can cover the aperture in the respective end wall 116A-C. As shown in FIG. 13, the take off shaft 214 can extend substantially parallel to the axis of the main drive shaft (not shown), or alternatively, can be perpendicular thereto, or arranged at other angles. The gears 212, 213 can be sized to output a speed and direction that is suitable for driving the handrail of the people mover, or other feature, and may be of the same gear module as the output gear 118.

Referring back to FIG. 3, the housing 116 of the power transmission system 110 can be flat and thin (e.g., have a narrow width). As a result, the power transmission system 110 can be mounted outboard of the step band defined by the lateral dimension of the passenger platforms 114, allowing a reduction in the vertical distance between the "upper" platform path and the "lower" platform path. This can reduce the packaging requirements of the drive mechanism and the people mover itself, thus greatly enhancing the utility of the people mover in environments that would otherwise preclude the use of a more space-intensive mechanism.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. A power transmission system for a people mover, comprising:
- a transmission housing;
- a first motor having a motor shaft;
- a plurality of gears located inside the transmission housing, comprising:
  - an output gear located inside the transmission housing; and
  - first and second reduction gears cooperating to drive the output gear, at least one of the first and second reduction gears having an input/output shaft extending outside the transmission housing; and
- an external reduction stage located outside the transmission housing and driven by the first motor shaft to rotate the input/output shaft, wherein the external reduction stage comprises:
  - a first pulley coupled to the motor shaft;
  - a second pulley coupled to the input/output shaft; and
  - a belt or chain extending around the first pulley and the second pulley.

2. The power transmission system of claim 1, wherein the external reduction stage is removable from the motor shaft and the input/output shaft, the system further comprising an internal reduction stage connecting the motor shaft to the first reduction gear.

3. The power transmission system of claim 1, wherein the input/output shaft provides a power take off when the external reduction stage is removed from the input/output shaft.

4. The power transmission system of claim 1, further comprising an internal reduction stage including an input gear located on the motor shaft and in engagement with the first reduction gear.

5. The power transmission system of claim 4, wherein the internal reduction stage comprises a first pulley located on the motor shaft, and a belt or chain extending around the first pulley and a portion of the first reduction gear.

6. The power transmission system of claim 1, wherein the transmission housing includes first and second opposed sidewalls, the system further comprising:
- a first bearing coupled to the first sidewall to support one of the plurality of gears for rotation about an axis; and
- a second bearing coupled to the second sidewall to support the one of the plurality of gears for rotation about the axis;

wherein the first bearing transmits axial loads from the one of the plurality of gears to the first sidewall along the axis, and the second bearing does not transmit axial loads from the one of the plurality of gears to the second sidewall along the axis.

7. The power transmission system of claim 6, further comprising:

a first removable cap covering an aperture in the first sidewall, wherein the first bearing is immovable with respect to the first removable cap in the axial direction, and the first bearing is immovable with respect to the one of the plurality of gears in the axial direction.

8. The power transmission system of claim 7, further comprising:

a second removable cap covering an aperture in the second sidewall, wherein the second bearing is slidably mounted to the second removable cap, or the second bearing is slidably mounted to the one of the plurality of gears.

9. The power transmission system of claim 1, wherein the transmission housing includes first and second opposed sidewalls, and an end wall extending between the first and second sidewalls, the system further comprising:

an auxiliary power take off removably mounted to the end wall over an aperture, the auxiliary power take off including a take-off gear driven by the output gear through the aperture, and a take-off shaft driven by the take-off gear.

10. The power transmission system of claim 9, further comprising a removable end plate covering the aperture when the auxiliary power take off is removed from the end wall.

11. The power transmission system of claim 1, further comprising a second motor having a second motor shaft that drives the first reduction gear.

12. The power transmission system of claim 1, further comprising:

a second motor having a second motor shaft; and a second plurality of gears driven by the second motor shaft to drive the output gear.

13. A people mover, comprising:

the power transmission system of claim 1; and a main drive shaft coupled to a drive wheel to circulate a plurality of interconnected passenger platforms;

wherein the output gear of the power transmission system includes a central aperture that slides onto the main drive shaft and transfers rotational movement to the main drive shaft.

14. The people mover of claim 13, further comprising:

a second power transmission system having a second output gear, wherein the second output gear includes a second central aperture that slides onto the main drive shaft and transfers rotational movement to the main drive shaft.

15. The people mover of claim 13, wherein the people mover includes a plurality of passenger platforms defining a step band, and the transmission housing of the power transmission system is located laterally outside the step band.

16. The power transmission system of claim 6, wherein at least one of the first bearing and the second bearing comprises a ball bearing, a deep groove ball bearing, a cylindrical roller bearing, or a spherical roller bearing.

17. The power transmission system of claim 1, wherein the plurality of gears located inside the transmission housing are supported by ball bearings, deep groove ball bearings, cylindrical roller bearings, or spherical roller bearings to minimize the overall width of the transmission housing.

* * * * *